US010505309B2

(12) United States Patent
Poterjoy

(10) Patent No.: US 10,505,309 B2
(45) Date of Patent: Dec. 10, 2019

(54) ELECTRICAL DEVICE HAVING A SEAL ASSEMBLY

(71) Applicant: TE CONNECTIVITY CORPORATION, Berwyn, PA (US)

(72) Inventor: Joshua Carl Poterjoy, Bainbridge, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/813,508

(22) Filed: Nov. 15, 2017

(65) Prior Publication Data

US 2019/0148873 A1 May 16, 2019

(51) Int. Cl.

| | |
|---|---|
| ***H01R 13/40*** | (2006.01) |
| ***H01R 13/52*** | (2006.01) |
| ***H01R 13/533*** | (2006.01) |
| ***H01R 13/50*** | (2006.01) |
| *H01R 13/58* | (2006.01) |

(52) U.S. Cl.

CPC ..... *H01R 13/5202* (2013.01); *H01R 13/501* (2013.01); *H01R 13/5208* (2013.01); *H01R 13/533* (2013.01); *H01R 13/5808* (2013.01)

(58) Field of Classification Search

CPC ..... H01R 13/5202; H01R 13/6272; H01R 13/6275; H01R 13/506; H01R 13/508; H01R 13/4536; H01R 13/533; H01R 13/5808; H01R 13/5208

See application file for complete search history.

(56) References Cited

U.S. PATENT DOCUMENTS

| | | | | |
|---|---|---|---|---|
| 2,619,515 A * | 11/1952 | Doane | H01R 13/4536 174/167 |
| 5,306,195 A | 4/1994 | Hayashi | |
| 5,315,062 A * | 5/1994 | Hoshino | H01R 13/506 174/72 C |
| 5,593,321 A | 1/1997 | Hotea | |
| 6,152,767 A * | 11/2000 | Roosen | H02G 15/113 439/587 |
| 6,171,136 B1 * | 1/2001 | Liu | H01R 13/506 439/465 |
| 6,302,734 B1 * | 10/2001 | Ichio | H01R 13/5208 439/274 |
| 6,579,113 B2 * | 6/2003 | Kodama | H01R 13/6272 439/358 |

(Continued)

FOREIGN PATENT DOCUMENTS

| | | |
|---|---|---|
| JP | 5-53155 U | 7/1993 |
| JP | 0362122 | 12/2005 |

(Continued)

*Primary Examiner* — Jean F Duverne

(57) ABSTRACT

An electrical device includes a housing having a mating end and a wire end. One or more contacts attach to the housing proximate the mating end. One or more conductor wires extending from the wire end and connect to the one or more contacts. A seal assembly connects to the housing proximate the wire end. The seal assembly is configured for movement between an opened position and a closed position. The seal assembly has an upper seal and a lower seal configured to mate along an interface in the closed position to limit the ingress of one or more environmental elements into the electrical device.

20 Claims, 3 Drawing Sheets

(56) References Cited

U.S. PATENT DOCUMENTS

| | | | | |
|---|---|---|---|---|
| 6,902,432 | B2 * | 6/2005 | Morikawa | H01R 13/6275 439/607.41 |
| 7,731,530 | B2 | 6/2010 | Takahashi | |
| 2008/0236863 | A1 * | 10/2008 | King | H01R 4/22 174/92 |

FOREIGN PATENT DOCUMENTS

| | | |
|---|---|---|
| JP | 2008186706 | 8/2008 |
| JP | 2016103346 | 6/2016 |

* cited by examiner

ELECTRICAL DEVICE HAVING A SEAL ASSEMBLY

BACKGROUND OF THE INVENTION

The subject matter herein relates generally to an electrical connector having a seal assembly.

Electrical connectors provide communicative interfaces between electrical components where power and/or signals may be transmitted therethrough. In some applications, electrical connectors may be exposed to environmental elements, such as moisture, contaminants, and corrosive elements. Ingress of any of these elements into the electrical connector can occur at interfaces between discrete components of the electrical connector and undesirably affect the operation and reliability of the connector. For example, an electrical connector having multiple components, such as a housing, contacts, and wires, can include openings and/or gaps therebetween due to misalignment or variances in tolerances that permit ingress of environmental elements.

Therefore, electrical connectors may also include additional discrete components to protect or seal the interior of the electrical connector from ingress by one or more environmental elements in the exterior environment. For example, electrical connectors may include protective covers, O-rings, seals, overmolded components, feed-thru assemblies, and the like. However, each additional component used in the electrical connector requires additional tooling, manufacture, and assembly, thus increasing cost and assembly time. For example, discrete components may be separately manufactured and later assembled at multiple locations. Furthermore, the additional components may require customized variants, rather than a single universal component, to accommodate different specifications in each application. For example, multiple configurations of a seal assembly may be required to accommodate similar electrical connectors using different gauges of wires and/or different types or sizes of contacts.

Accordingly, there is a need for an electrical connector that includes a seal assembly.

BRIEF DESCRIPTION OF THE INVENTION

In one embodiment, an electrical device is provided that includes a housing having a mating end and a wire end. One or more contacts attach to the housing proximate the mating end. One or more conductor wires extending from the wire end and connect to the one or more contacts. A seal assembly connects to the housing proximate the wire end. The seal assembly is configured for movement between an opened position and a closed position. The seal assembly has an upper seal and a lower seal configured to mate along an interface in the closed position to limit the ingress of one or more environmental elements into the electrical device.

In another embodiment, an electrical device is provided that includes a housing configured for mating with a mating connector. The housing has a body with a mating end and a wire end. One or more contacts attach to the body proximate the mating end with one or more hinges. One or more conductor wires proximate the wire end and connect to the one or more contacts. A seal assembly connects to the body proximate the wire end, the seal assembly being configured for movement between an opened position and a closed position. The seal assembly has an upper seal and a lower seal configured to mate along an interface in the closed position to limit the ingress of one or more environmental elements into the electrical device.

In another embodiment, a seal assembly for an electrical device having a housing with a mating end and a wire end, a contact attached to the housing proximate the mating end, and a conductor wire proximate the wire end and connected to the contact is provided that includes an upper shell having an upper wall and opposed upper sidewalls that define an upper interior surface configured to receive an upper seal. The seal assembly also includes a lower shell having a lower wall and opposed lower sidewalls that define a lower interior surface configured to receive a lower upper seal. The seal assembly is configured for movement between an opened position and a closed position. The upper seal and the lower seal is configured to mate along an interface in the closed position to limit the ingress of one or more environmental elements into the electrical device.

DETAILED DESCRIPTION OF THE INVENTION

Embodiments described herein include electrical devices that have electrical connectors and seal assemblies. For example, the electrical device may have one or more electrical connectors, such as a plug connector and a receptacle connector. The electrical connectors may have a variety of configurations as set forth herein. For example, embodiments may include a housing having a seal assembly configured to form a seal along an interface between discrete components. The seal assembly may include an upper shell and a lower shell having a respective upper seal and lower seal that move between an open and closed position to seal along an interface to prevent, shield, and or limit ingress of environmental elements into the electrical connector. Optionally, the seal assembly may seal along an interface of one or more discrete components passing through the seal assembly into the electrical connector. The seal assembly may have a variety of configurations as set forth herein.

Figure 1:
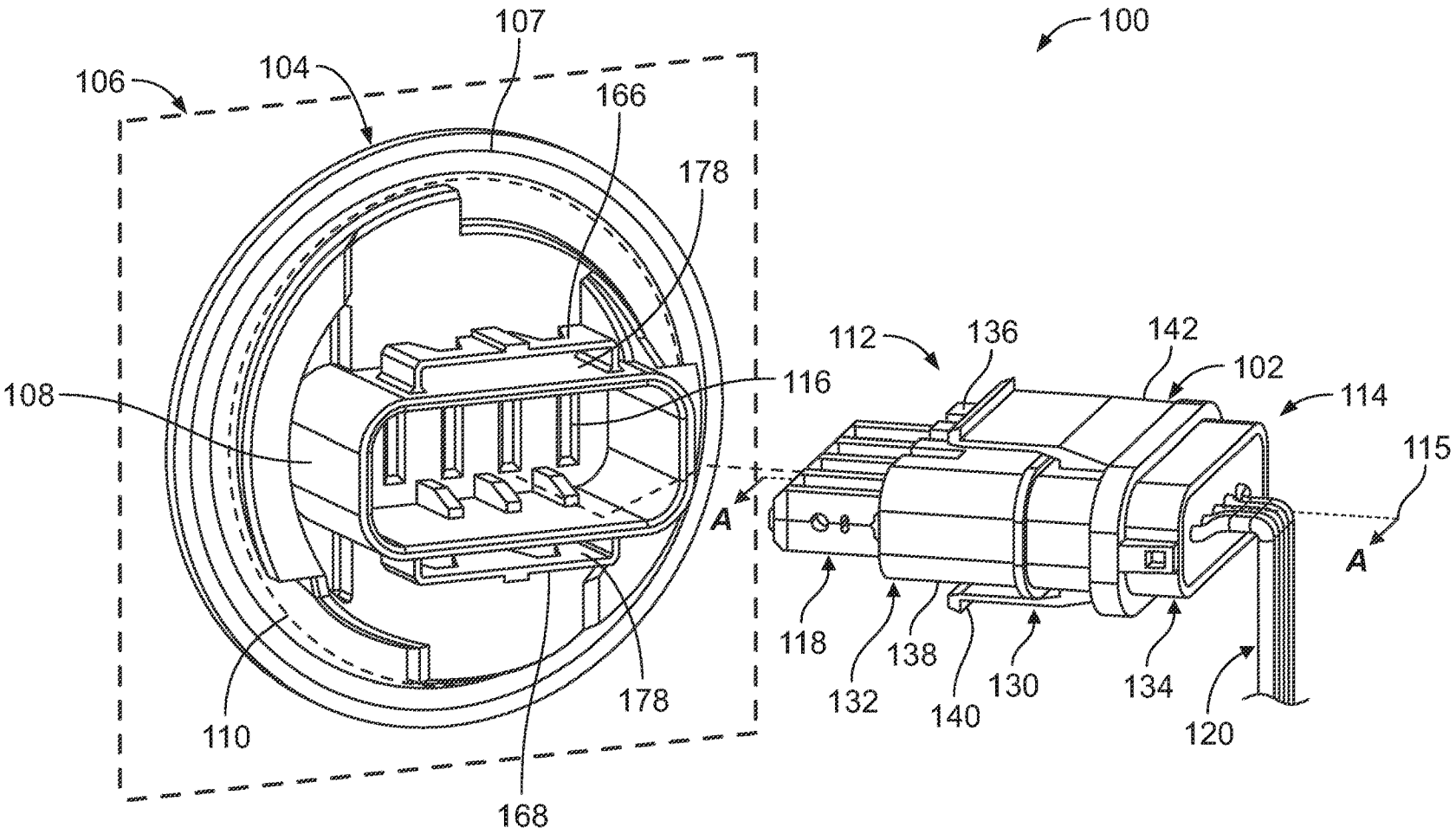
FIG. 1 is a perspective view of an electrical device according to an embodiment.

FIG. 1 is a perspective view of an electrical device system 100 in accordance with an embodiment. The electrical device 100 includes one or more connectors, such as a plug connector 102 configured to be releasably connected or mated to a receptacle connector 104 that may be mounted to a panel 106. The panel 106 may be a wall of an electrical device (not shown), a wall of a container that holds one or more devices therein, or a wall of another structure. In an exemplary embodiment, the receptacle connector 104 is a twist-lock connector configured for mounting to the panel 106 so that a receptacle 108 extends through an opening 110 of the panel 106. Optionally, the receptacle connector 104 may include a seal 107, such as an O-ring or gasket, configured to seal between the receptacle connector 104 and the panel 106. As shown in FIG. 1, the receptacle 108 is generally rectangular shaped, however, the receptacle 108 can embody any shape, such as cylindrical, spherical, and the like. Alternatively, the receptacle connector 104 can be any type of connector configured to releasably connect with the plug connector 102. Optionally, the receptacle connector 104 is electrically connected to an electrical device (not shown) or may be configured for connection with an auxiliary connector (not shown).

The plug connector 102 includes a mating end 112 opposite a wire end 114. The mating end 112 is configured for insertion into the receptacle 108 of the receptacle connector 104 along a central longitudinal axis 115 to establish an electric connection therebetween. In an exemplary embodiment, the receptacle connector 104 includes one or more receptacle contacts 116 configured to electrically connect to one or more plug contacts 118 at the mating end 112 of the plug connector 102. In the illustrated embodiment, the plug connector 102 is terminated at the wire end 114 to one or more conductor wires 120. Power and or data signals may be transmitted along the conductor wires 120 to the plug contacts 118 through the plug connector 102 when mated to the receptacle connector 104. While the plug connector 102 is illustrated as being terminated to conductor wires 120, the plug connector 102 may be terminated to other components, such as a cable, flex circuit, contacts, and the like. In an alternate embodiment, the receptacle connector 104 may not include receptacle contacts 116. Instead, the plug contacts 118 may extend or pass through the receptacle connector 104 for mating with an auxiliary connector (not shown).

Figure 2:
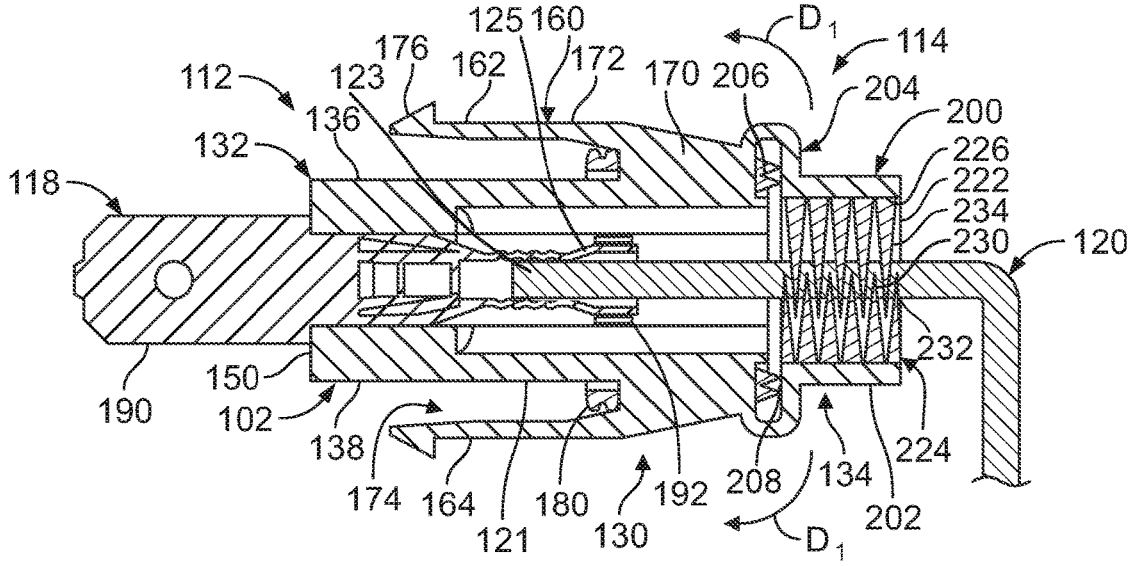
FIG. 2 is a cross-section view of a plug connector along A-A of FIG. 1 according to an embodiment.

FIG. 2 is a cross-section view of the plug connector 102 along A-A of FIG. 1 according to an embodiment. The plug connector 102 includes a housing 130 having a body 132 proximate to the mating end 112 and a seal assembly 134 proximate to the wire end 114. The body 132 includes an upper wall 136, a lower wall 138, and first and second sidewalls 140, 142 (FIG. 1) extending therebetween to form one or more contact ports 150 that extend through the body 132 between the mating end 112 and the wire end 114. The contact ports 150 are configured to receive the plug contacts 118. For example, the plug contacts 118 may be held in the contact ports 150 with a mechanical interference fit proximate the mating end 122. Alternatively, the plug contacts 118 may be held in the contact ports 150 using adhesive, welding, and the like. Optionally, the body 132 and the global seal assembly 134 may be integrally formed. For example, the body 132 and the global seal assembly 134 may be co-molded, such as with a two-part molding process. In another embodiment, the body 132 and the global seal assembly 134 may be formed as separate pieces that are mechanically joined.

The housing 130 includes a securing feature 160 to secure the plug connector 102 to the receptacle connector 104. In the illustrated embodiment, the securing feature 160 includes an upper latch 162 and a lower latch 164 configured to releasably couple with a corresponding upper catch 166 and lower catch 168 of the receptacle connector 104 (FIG. 1). For example, each latch 162, 164 includes a base 170 attached to the respective upper and lower wall 136, 138 at the wire end 114 and a tab 172 extending from the base 170 towards the mating end 112. Each tab 172 terminates at a detent 176 that is configured to engage and disengage within a slot 178 of the respective upper and lower catch 166, 168 (FIG. 1). Each tab 172 may be deflectable into a gap 174. The gap 174 allows each tab 172 to deflect inward towards the body 132 during engagement and disengagement with the respective catch 166, 168. Alternatively, other types of securing features may be used to secure the plug connector 102 to the receptacle connector 104, such as fastener, a retaining member, a mechanical interference fit, bonding, adhesive, and the like.

In an exemplary embodiment, the housing 130 includes a front seal 180 configured to form a seal along an interface (not shown) between the plug connector 102 and the receptacle connector 104 that, when mated, prevents ingress of one or more environmental elements into the receptacle 108. For example, the front seal 180 may be positioned about the perimeter of the body 132 proximate the wire end 114 and adjacent to the bases 170 of the upper and lower latches 162, 164. When the plug connector 102 is mated with the receptacle connector 104, the front seal 180 forms a seal at the interface between the body 132 and the receptacle 108. However, in alternate embodiments, the front seal 180 may have any configuration that forms a seal between the plug connector 102 and the receptacle connector 104.

In various embodiments, the housing 130 may be molded, stamped, die cast, or otherwise formed from any suitable material, including, polymer, metal, dielectric material, composite materials, stainless steel, copper, aluminum, alloys, and the like. Optionally, the housing 130 may be formed from a material that limits or prevents the transmission of EMI and/or electromagnetic radiation through the housing 130.

Each plug contact 118 includes a mating end 190 configured for mating with the corresponding receptacle contact 116 of the receptacle connector 104 and an opposite wire terminating end 192 configured for electrical and mechanical connection with the wires 120. In an exemplary embodiment, each mating end 190 may be a male terminal, such as a blade terminal. However, other types of terminals may be used in alternative embodiments, such as a post, jack, plug, spade terminal, fork terminal, female terminal, sealant, and the like. The mating ends 190 of the plug contacts 118 form planes that are parallel with respect to each other and extend parallel with respect to the longitudinal axis 115 of the plug connector 102. However, alternative embodiments may include mating ends 190 that are not parallel and do not oppose each other. In an exemplary embodiment, each wire terminating end 192 may be crimped to a wire end 121 of the corresponding wire 120. However, other types of connections can be used to connect the wires 120 to the wire ends 121, such as, barrel connection, butt connection, cap connection, insulation displacement contact, solder connection, and the like.

The plug contacts 118 may each be fabricated from any suitable electrically conductive material(s) that enables the plug contacts 118 to electrically connect the components of the plug connector 102 and/or that enables the plug connector 102 to function as described herein, such as, but not limited to, silver, aluminum, gold, copper, other metallic conductors, non-metallic conductors (such as, but not limited to, carbon and/or the like), and/or the like. For example, the plug contacts 118 may be stamped and formed copper contacts used for data or power transmission.

In the exemplary embodiment, each of the wires 120 includes an electrical conductor 123 and an insulating jacket 125. In other embodiments, each of the wires 120 may be shielded along at least a portion of the length of the wire 120, and unshielded along at least a portion of the length of the wire 120 for coupling with the plug contacts 118. The wires 120 may be shielded using any suitable arrangement, configuration, structure, means, and/or the like, such as, but not limited to, surrounding at least a portion of the electrical conductors 123 with any suitable electrically insulative material(s) (not shown), and surrounding at least a portion of the insulative material with an electrically conductive material (not shown) that is at least partially surrounded by the insulating jacket 125.

The electrical conductors 123 may each be fabricated from any suitable electrically conductive material(s) that enables the electrical conductors 123 to electrically connect the components of the plug connector 102 and/or that enables the plug connector 102 to function as described herein, such as, but not limited to, silver, aluminum, gold, copper, other metallic conductors, non-metallic conductors (such as, but not limited to, carbon and/or the like), and/or the like. The electrical conductors 123 may also have any suitable configuration, shape, and/or the like that that enables the electrical conductors 123 to electrically connect the components of the plug connector 102 and/or that enables the plug connector 102 to function as described herein, such as, but not limited to, an approximately cylindrical wire (whether the wire consists of a plurality of strands or only one strand), an approximately planar shape, and/or the like. The insulating jacket 125 may be fabricated from any suitable insulative material(s) that facilitates insulating the electrical conductors 123 and/or that enables the plug connector 102 to function as described herein, such as, but not limited to, polyester, polyvinyl chloride, thermoplastic-elastomer, and/or polyimide.

Figure 3:
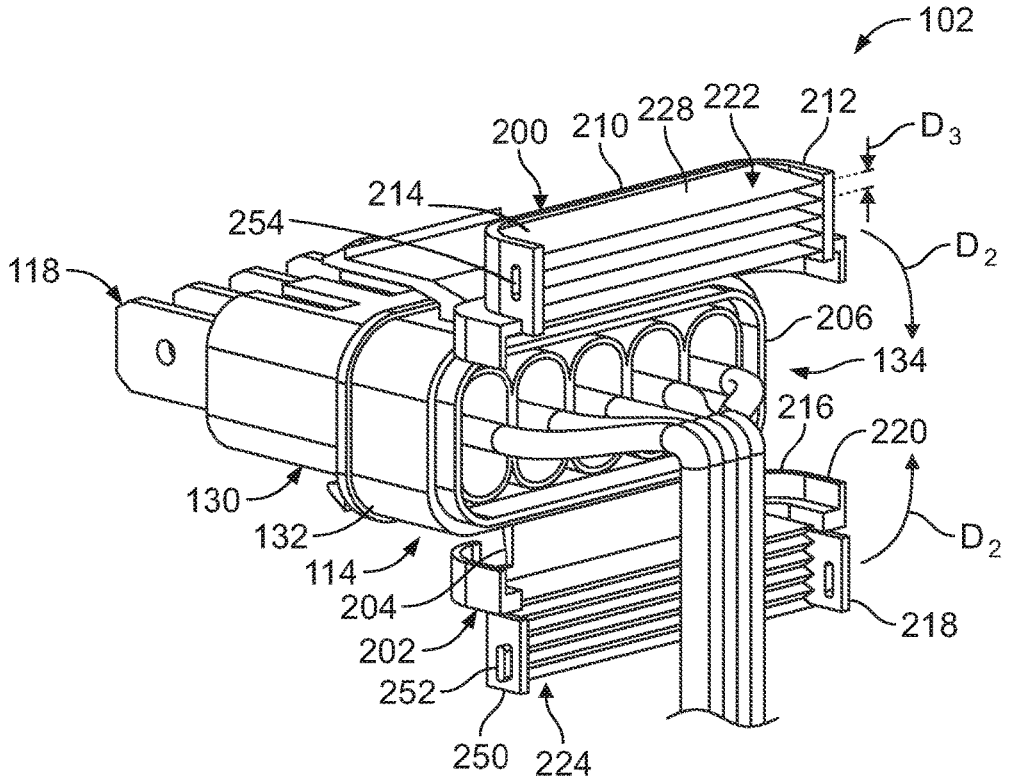
FIG. 3 is a perspective view of the plug connector of FIG. 1 in an opened position according to an embodiment.

FIG. 3 is a perspective view of the plug connector of FIG. 1 in an opened position according to an embodiment. The seal assembly 134 includes an upper shell 200, and a lower shell 202 moveably attached to the body 132 proximate the wire end 114 of the housing 130 for movement between the opened position and the closed position (FIG. 2). In an exemplary embodiment, the upper and lower shells 200, 202 pivotally connect to the body 132 with hinges 204 for rotation about the hinges 204. The upper and lower shells 200, 202 are moveable in a first direction $D_1$ into the opened position (FIG. 2), and moveable in a second direction $D_2$ into the closed position (FIG. 3). Optionally, the seal assembly 134 includes a rear seal 206 configured to form a seal along an interface 208 between a surface of the body 132, such as a rear end of the body 132, and mating surfaces of the upper and lower shells 200 and 202 when mated in the closed position (FIG. 2). The rear seal 206 prevents ingress of one or more environmental elements into the plug connector 102. For example, the rear seal 206 may be positioned along the entire perimeter of the mating surface of the body 132. However, in alternate embodiments, the rear seal 206 may have any configuration that forms a seal between the plug connector 102 and the receptacle connector 104.

The upper shell 200 includes an upper wall 210 and opposed upper sidewalls 212 that define an upper interior surface 214. The lower shell 202 includes a lower wall 216 and opposed lower sidewalls 218 that define a lower interior surface 220. The seal assembly 134 includes a respective upper seal 222 and lower seal 224 attached to the interior surfaces 214, 220 of the upper and lower shells 200, 202. The upper and lower seals 222, 224 each include a base 226 and one or more seal components 228 configured to mate and form a seal along a seal interface 230 (FIG. 2) to prevent ingress of one or more environmental elements into the plug connector 102. In addition, the upper and lower seals 222, 224 are configured to form a seal along a component interface 232 with discrete components that pass through the seal assembly 134 into the ports 150 of the plug connector 102. For example, the upper and lower seals 222, 224 may form a seal along the component interface 232 of the wires 120 that pass through the seal assembly 134 while in the closed position and into the ports 150 of the plug connector 102 to connect with the plug contacts 118.

In an exemplary embodiment, the seal components 228 may include longitudinal ribs extending at a substantially right angle from the base 226. The seal components 228 are configured to compress against each other to form an effective seal. In addition, the seal components 228 are configured to compress against the wires 120 to form an effective seal against the insulating jacket 125 of the wires and to form a seal in the space between the wires 120. Each rib has a generally triangular cross-section that tapers to a point opposite the base 226 (FIG. 2). As shown, the upper and lower seals 222, 224 include five (5) seal components 228 spaced apart at a distance $D_3$ and defining channels 234 therebetween. When in the closed position, the seal components 228 may mate along the interface 230 in an interleaved configuration with seal components 228 of the upper seal 222 positioned in the channels 234 of the lower seal 224 and with seal components 228 of the lower seal 224. However, the seal components 228 may be any configuration, arrangement, and/or pattern, including any number of rows or columns. Optionally, the seal components 228 may define any size or shape effective for forming a seal.

The upper and lower seals 222, 224 may be fabricated from any suitable material(s) that facilitates forming a seal and/or that enables the seal assembly 134 and plug connector 102 to function as described herein, such as, but not limited to, rubber, polymers, elastomers, and the like. Optionally, the upper shell 200, lower shell 202, upper seal 222, and lower seal 224 may be integrally formed. For example, the upper and lower shells 200, 202 and upper and lower seals 222, 224 may be co-molded, such as with a two-part molding process. In another embodiment, the upper shell 200, lower shell 202, upper seal 222, and lower seal 224 may be formed as separate pieces that are mechanically joined.

Optionally, the seal assembly 134 may include a securing feature 250 configured to releasably couple the upper shell 200 with the lower shell 202. In the illustrated embodiment, the securing feature 250 includes a detent 252 that is configured to engage and disengage with a slot 254 of the respective lower shell 202 (FIG. 1). Alternatively, other types of securing features may be used to secure the upper shell 200 to the lower shell 202, such as fastener, a retaining member, a mechanical interference fit, bonding, adhesive, and the like.

Figure 4:
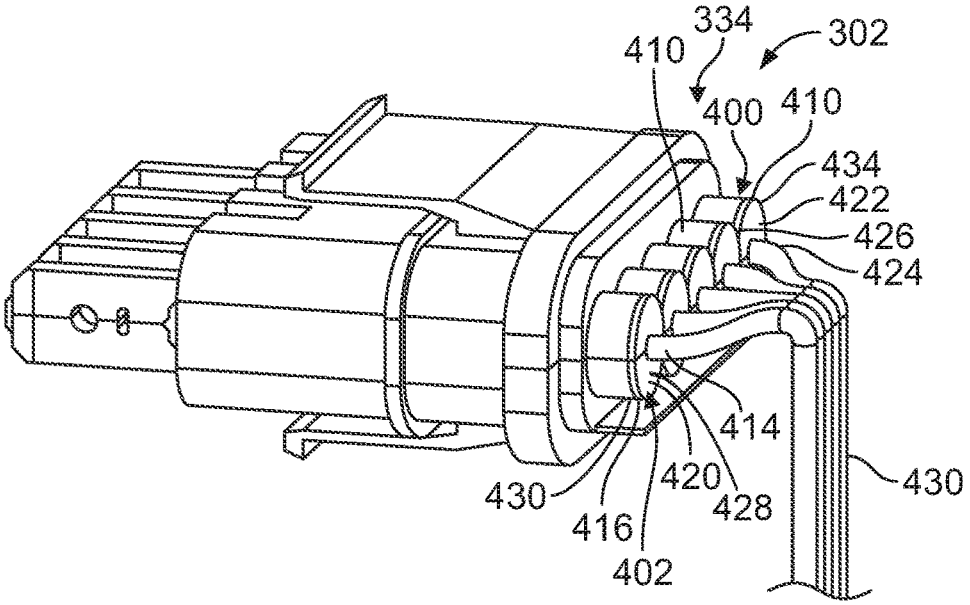
FIG. 4 is a perspective view of an alternate embodiment of a plug connector according to an embodiment.
Figure 5:
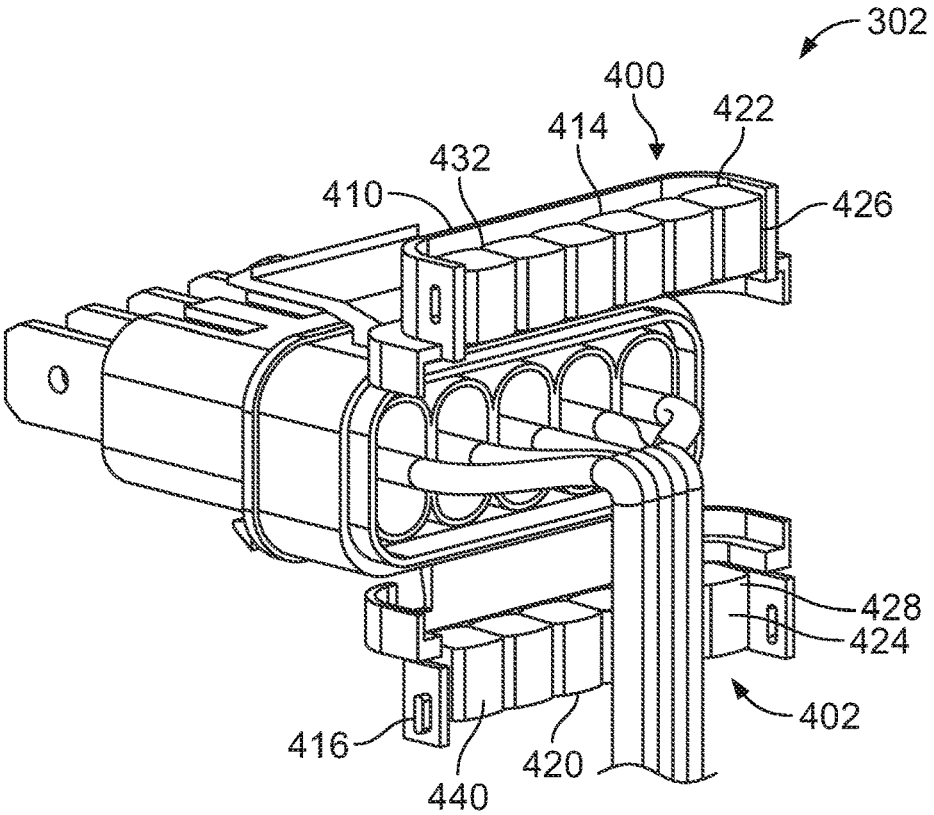
FIG. 5 is a perspective view of the plug connector of FIG. 4 in an opened position according to an embodiment.

FIG. 4 is a perspective view of an alternate embodiment of a plug connector 302 according to an embodiment. FIG. 5 is a perspective view of the plug connector 302 of FIG. 4 in an opened position according to an embodiment. In an exemplary embodiment, the plug connector 302 is identical to the embodiment of FIGS. 1-3 except for the configuration of the seal assembly 334, upper and lower shells 400, 402 and the upper and lower seals 422, 424.

The upper shell 400 includes an upper wall 410 that defines an upper interior surface 414. In an exemplary embodiment, the upper wall 410 includes five (5) semi-cylindrical shaped portions 426 configured to mate with upper seal 422 along the interior surface 414. The lower shell 402 includes a lower wall 416 that defines a lower interior surface 420. In an exemplary embodiment, the lower wall 416 includes five (5) semi-cylindrical shaped portions 428 configured to mate with lower seal 424 along the lower interior surface 420.

The upper and lower seals 422, 424 are configured to mate and form a seal along a seal interface 430 to prevent ingress of one or more environmental elements into the plug connector 302. In addition, the upper and lower seals 422, 424 are configured to form a seal along a component interface 432 with discrete components that pass through the seal assembly 334 into the plug connector 302. For example, the upper and lower seals 422, 424 may form a seal along the component interface 432 with the wires 320 that pass through the seal assembly 334 while in the closed position and into the plug connector 302.

In an exemplary embodiment, the upper and lower seals 422, 424 include seal components 428. The seal components 428 are configured to compress against each other to form an effective seal. In addition, the seal components 428 are configured to compress against the wires 320 to form an effective seal against the insulating jacket 125 of the wires and to form a seal in the space between the wires 320. Each seal component 428 may include a semi-cylindrical segment having an upper surface 434 configured to mate with the interior surfaces 414, 420 of the upper and lower shells 400, 402 and a generally planar mating surface 440. As shown, the upper and lower seals 422, 424 include five (5) seal components 428 mated with corresponding the upper and lower shells 400, 402. When in the closed position, the seal components 428 may mate along the interface 430 between the mating surfaces 440. However, the seal components 428 may be any configuration, arrangement, and/or pattern, including any number of rows or columns. Optionally, the seal components 428 may define any size or shape effective for forming a seal.

The upper and lower seals 422, 424 may be fabricated from any suitable material(s) that facilitates forming a seal and/or that enables the seal assembly 334 and plug connector 302 to function as described herein, such as, but not limited to, rubber, polymers, elastomers, and the like. Optionally, the upper shell 400, lower shell 402, upper seal 422, and lower seal 424 may be integrally formed. For example, the upper and lower shells 400, 402 and upper and lower seals 422, 424 may be co-molded, such as with a two-part molding process. In another embodiment, the upper shell 400, lower shell 402, upper seal 422, and lower seal 424 may be formed as separate pieces that are mechanically joined.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical device comprising:

a housing having a mating end and a wire end;

one or more contacts attached to the housing proximate the mating end;

one or more conductor wires extending from the wire end and connected to the one or more contacts; and a seal assembly pivotally connected to the housing proximate the wire end, the seal assembly being configured for movement between an opened position and a closed position, the seal assembly having an upper shell configured to receive an upper seal and a lower shell configured to receive a lower seal, wherein the upper seal is configured to move with movement of the upper shell and the lower seal is configured to move with movement of the lower shell, wherein the upper seal and the lower seal are configured to mate along a seal interface in the closed position to limit the ingress of one or more environmental elements into the electrical device.

2. The electrical device of claim 1, further comprising one or more hinges pivotally connected between the housing and the seal assembly, the one or more hinges configured to pivot the seal assembly in a first direction to the opened position and to pivot the seal assembly in a second direction into the closed position.

3. The electrical device of claim 1, wherein the upper seal and lower seal mate along the seal interface with the one or more conductor wires to limit the ingress of the environmental elements into the electrical device.

4. The electrical device of claim 1, the seal assembly further comprising:

the upper shell having an upper wall and opposed upper sidewalls that define an upper interior surface configured to receive the upper seal; and the lower shell having a lower wall and opposed lower sidewalls that define a lower interior surface configured to receive the lower seal.

5. The electrical device of claim 4, the upper and lower seals each including a base configured for attachment to respective upper and lower interior surfaces of the upper and lower shells, and a plurality of seal components extending from each base; and wherein the seal components define longitudinal ribs spaced apart at a distance therebetween and configured to engage each other in an interleaved configuration in the closed position.

6. The electrical device of claim 4, wherein the upper seal is co-molded with the upper shell, and the lower seal is co-molded with the lower shell.

7. The electrical device of claim 1, further comprising a rear seal configured to form a seal along an interface between a mating surface of the housing and mating surfaces of the seal assembly when mated in the closed position.

8. The electrical device of claim 1, wherein the seal assembly is co-molded with the housing.

9. An electrical connector, comprising:

a housing configured for mating with a mating connector, the housing having a body with a mating end and a wire end;

one or more contacts attached to the body proximate the mating end;

one or more conductor wires extending from the wire end and connected to the one or more contacts; and a seal assembly connected to the body proximate the wire end, the seal assembly being configured for movement between an opened position and a closed position, the seal assembly having an upper seal and a lower seal configured to mate along a seal interface in the closed position to limit the ingress of one or more environmental elements into the electrical connector, wherein at least one of the upper seal and the lower seal are pivotably coupled to the housing and moveable between the opened position and the closed position.

10. The electrical connector of claim 9, wherein the seal assembly comprises one or more hinges operably coupled between the corresponding upper seal or the lower seal and the housing, the one or more hinges are configured to pivot the seal assembly in a first direction to the opened position and to pivot the seal assembly in a second direction into the closed position.

11. The electrical connector of claim 9, wherein the upper seal and lower seal mate along a component interface with the one or more conductor wires to limit the ingress of the environmental elements into the electrical connector.

12. The electrical connector of claim 9, the seal assembly further comprising:

an upper shell having an upper wall and opposed upper sidewalls that define an upper interior surface configured to receive the upper seal; and a lower shell having a lower wall and opposed lower sidewalls that define a lower interior surface configured to receive the lower seal.

13. The electrical connector of claim 12, the upper and lower seals each including a base configured for attachment to respective upper and lower interior surfaces of the upper and lower shells, and a plurality of seal components extending from each base; and wherein the seal components define longitudinal ribs spaced apart at a distance therebetween and configured to engage each other in an interleaved configuration in the closed position.

14. The electrical connector of claim 12, wherein the upper seal is co-molded with the upper shell, and the lower seal is co-molded with the lower shell.

15. The electrical connector of claim 9, further comprising a rear seal configured to form a seal along an interface between a mating surface of the body and mating surfaces of the seal assembly when mated in the closed position.

16. The electrical connector of claim 9, wherein the seal assembly is co-molded with the body.

17. A seal assembly for an electrical device having a housing with a mating end and a wire end, a contact attached to the housing proximate the mating end, and a conductor wire proximate the wire end and connected to the contact, comprising:

an upper shell having an upper wall and opposed upper sidewalls that define an upper interior surface configured to receive an upper seal; and a lower shell having a lower wall and opposed lower sidewalls that define a lower interior surface configured to receive a lower seal;

the seal assembly being configured for movement between an opened position and a closed position, wherein the upper seal is configured to move with movement of the upper shell and the lower seal is configured to move with movement of the lower shell, the upper seal and the lower seal configured to mate along an interface in the closed position to limit the ingress of one or more environmental elements into the electrical device.

18. The seal assembly of claim 17, wherein the upper seal and lower seal mate along the interface with the one or more conductor wires to limit the ingress of the environmental elements into the electrical device.

19. The seal assembly of claim 17, wherein the upper and lower seals each include a base configured for attachment to respective upper and lower interior surfaces of the upper and lower shells, and a plurality of seal components extending from each base; and wherein the seal components define longitudinal ribs spaced apart at a distance therebetween and configured to engage each other in an interleaved configuration in the closed position.

20. The seal assembly of claim 17, wherein the upper seal is co-molded with the upper shell, and the lower seal is co-molded with the lower shell.

* * * * *